US009194122B2

(12) United States Patent
DaCosta

(10) Patent No.: US 9,194,122 B2
(45) Date of Patent: Nov. 24, 2015

(54) DOME ENCLOSURE

(71) Applicant: Carlos Alberto Henriques DaCosta, Ettrick, WI (US)

(72) Inventor: Carlos Alberto Henriques DaCosta, Ettrick, WI (US)

( * ) Notice: Subject to any disclaimer, the term of this patent is extended or adjusted under 35 U.S.C. 154(b) by 0 days.

(21) Appl. No.: 14/463,213

(22) Filed: Aug. 19, 2014

(65) Prior Publication Data

US 2015/0052827 A1 Feb. 26, 2015

Related U.S. Application Data

(60) Provisional application No. 61/867,680, filed on Aug. 20, 2013.

(51) Int. Cl.
*E04B 1/32* (2006.01)
*E04B 7/10* (2006.01)

(52) U.S. Cl.
CPC ..... *E04B 7/105* (2013.01); *E04B 1/3211* (2013.01); *E04B 7/10* (2013.01); *E04B 2001/3241* (2013.01); *E04B 2001/3252* (2013.01)

(58) Field of Classification Search
CPC ..... E04B 7/105; E04B 1/3211; E04B 7/10; E04B 2001/3252; E04B 2001/3241
See application file for complete search history.

(56) References Cited

U.S. PATENT DOCUMENTS 1,223,266 A * 4/1917 Dyer ..... 52/86
1,258,410 A * 3/1918 Hill ..... 52/82
3,256,653 A * 6/1966 Huff ..... 52/89
3,909,994 A * 10/1975 Richter ..... 52/63
3,919,813 A * 11/1975 Beindorf ..... 52/81.4
3,968,604 A * 7/1976 Hills ..... 52/86
3,999,337 A * 12/1976 Tomassetti et al. ..... 52/82
4,094,110 A * 6/1978 Dickens et al. ..... 52/81.1
4,133,150 A * 1/1979 Yacoboni ..... 52/81.2
4,245,809 A * 1/1981 Jackson ..... 249/15
4,297,814 A * 11/1981 Tomassetti et al. ..... 52/81.4
4,400,927 A * 8/1983 Wolde-Tinase ..... 52/745.08
4,680,901 A * 7/1987 Armitage ..... 52/81.4
4,873,796 A * 10/1989 Akmese ..... 52/81.4
4,876,828 A * 10/1989 Brill ..... 52/23
5,130,915 A * 7/1992 Lerch ..... 362/367
5,313,763 A * 5/1994 Oram ..... 52/80.2
5,341,610 A * 8/1994 Moss ..... 52/82
5,649,393 A * 7/1997 Barry et al. ..... 52/80.1
5,815,990 A * 10/1998 Barry et al. ..... 52/80.1
6,205,717 B1 * 3/2001 Shall et al. ..... 52/89
6,324,791 B1 * 12/2001 Azpiroz Villar ..... 52/80.1
6,536,167 B2 * 3/2003 Glavan ..... 52/81.3
7,237,363 B2 * 7/2007 Wilson ..... 52/80.1
7,882,660 B2 * 2/2011 Kitagawa ..... 52/81.1
2002/0144469 A1 * 10/2002 Glavan ..... 52/81.3
2004/0099977 A1 * 5/2004 Trottmann ..... 264/32
2005/0210767 A1 * 9/2005 DeFever et al. ..... 52/80.1

(Continued)

*Primary Examiner* — Rodney Mintz

(57) ABSTRACT

A dome enclosure that can be constructed on any foundation includes a plurality of dome structures and a bonding material. Each of the plurality of dome sections has a curved beam, a wall bracket, and a plurality of blocks. The wall bracket rests on the foundation and can be fitted for straight walls, curved walls, corners, etc. The curved beam is positioned into the wall bracket, wherein the wall bracket can be moved to readjust the position of the curved beam. The plurality of blocks are supported by the curved beam, wherein the plurality of blocks of an arbitrary section spans the distance to a subsequent section. Once the plurality of dome sections have been erected around the foundation, the bonding material is poured, or otherwise applied, wherein a single solid structure is formed.

20 Claims, 20 Drawing Sheets

(56) References Cited

U.S. PATENT DOCUMENTS

2008/0066393 A1* 3/2008 Sorensen ..... 52/81.1
2009/0025307 A1* 1/2009 Crichlow ..... 52/81.1
2009/0126292 A1* 5/2009 Kitagawa ..... 52/220.1
2009/0217617 A1* 9/2009 Kennedy et al. ..... 52/781
2015/0000216 A1* 1/2015 Noble ..... 52/80.1

* cited by examiner

DOME ENCLOSURE

The current application claims a priority to the U.S. Provisional Patent application Ser. No. 61/867,680 filed on Aug. 20, 2013.

FIELD OF THE INVENTION

The present invention relates generally to dome structures. More specifically, the present invention is a dome structure that can be constructed on any base (e.g. round wall, cornered walls, the ground). Furthermore, the present invention accommodates to any type of interior or exterior finish, such as wood, ceramic, stucco, etc.

BACKGROUND OF THE INVENTION

Once the Romans discovered that a dome is the strongest form of building, they built concrete domes extensively. The technique to build a dome has not changed much since then. Today we still use almost exactly the same method. In the Roman times concrete was reinforced with river bottom stones no bigger than fist size, and sometimes pozzolan ash also could be used. Pozzolan ash made the concrete extremely hard and waterproof (this ash was available near mount Vesuvius). Today we know that the best reinforcement for concrete is with steel rebar. Lately even steel rebar is being surpassed by basalt rebar, which is not destroyed by water or chemicals making it virtually indestructible. Once concrete reinforced with rebar takes a dome shape, it will last even longer, withstanding just about anything the weather can throw at it.

Today there are other modern systems of building domes using artificial materials such as an exterior rubber membrane liner. Foam is sprayed on the interior of the liner, steel rebar is attached to the foam, and then shot-crete is spayed to the desired thickness. In order to be able to spray the concrete, extremely small stones have to be used. Because the concrete spraying is done from the inside applying it upside down, working against gravity, strong chemicals are used to keep the concrete stuck to the walls so it does not fall down to the ground. This type of construction only offers a stucco or concrete finish on the interior. As these dome construction methods are relatively new, it is not known how long these structures will last or how much they can withstand over time. While they may work well in the short term, their long term benefits have yet to be tested.

One difficulty in building domes is in the foundation on which the dome is built. While it is easy to construct a dome about a round foundation, it is more difficult to do so about foundations of other shapes, such as squares and rectangles. While it is possible to build domes on such foundations using current dome construction techniques, such domes are often imperfect. Many provide curved surfaces, yet are formed in a more pyramidal shape.

Therefore it is the object of the present invention to provide a dome enclosure that can be constructed on any foundation. The present invention is based around traditional beam and block construction methods, and employs the use of unique wall brackets and intersection brackets. A plurality of dome sections is erected around a foundation and secured together using a bonding material. Each of the plurality of dome sections has a curved beam, a wall bracket, and a plurality of blocks. The wall bracket rests on the foundation and provides a mount for the curved beam. Additionally, the wall bracket allows the placement of the curved beam to be readjusted anytime before the bonding material is poured or otherwise applied. The plurality of blocks provides an interior finish, spanning from one curved beam to another. The present invention requires no scaffolding other than a central support to erect the dome structure, and allows for quicker construction of a dome.

DETAIL DESCRIPTIONS OF THE INVENTION

All illustrations of the drawings are for the purpose of describing selected versions of the present invention and are not intended to limit the scope of the present invention.

The present invention is a dome enclosure that can be constructed on any type of foundation. The present invention comprises a plurality of dome sections 10 and a bonding material 80, wherein the plurality of dome sections 10 is encased by the bonding material 80 to form a single rigid structure. In the preferred embodiment of the present invention, the bonding material 80 is concrete, however, it is possible for the bonding material 80 to be any material having similar characteristics and functionality to concrete.

Figure 1:
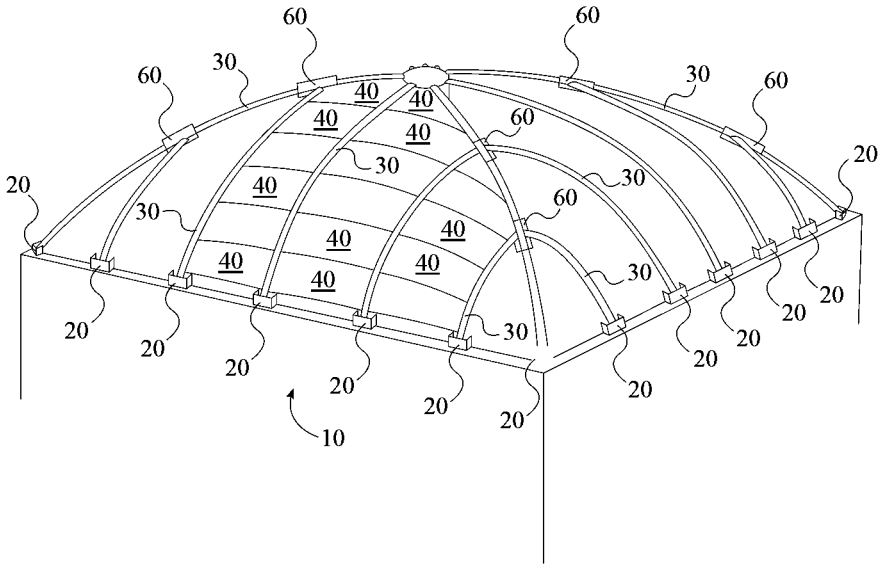
FIG. 1 is a diagram of a dome enclosure being constructed around a central support.
Figure 2:
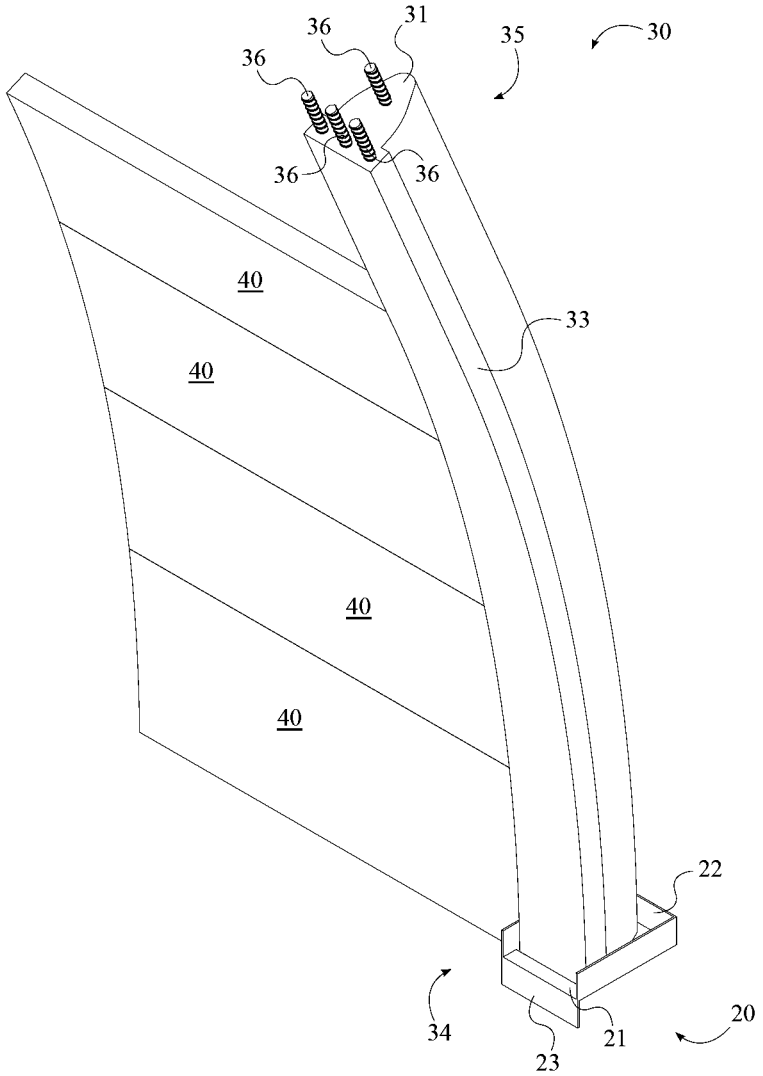
FIG. 2 is a perspective view of an arbitrary dome section.

In reference to FIG. 2, each of the plurality of dome sections 10 comprises a curved beam 30, a wall bracket 20, and a plurality of blocks 40. The wall bracket 20 is positioned on a wall or other support structure, as shown in FIG. 1, and provides a mount for the curved beam 30. The curved beam 30 is positioned into the wall bracket 20 and supports the plurality of blocks 40. The curved beam 30 of each of the plurality of dome structures has a specific curvature that is dependent on the size of the structure that supports the dome enclosure and the position of each of the plurality of dome sections 10. The specific curvature of the curved beam 30 is calculated such that the when the plurality of dome sections 10 is assembled together, a perfectly spherical interior is formed.

Figure 4:
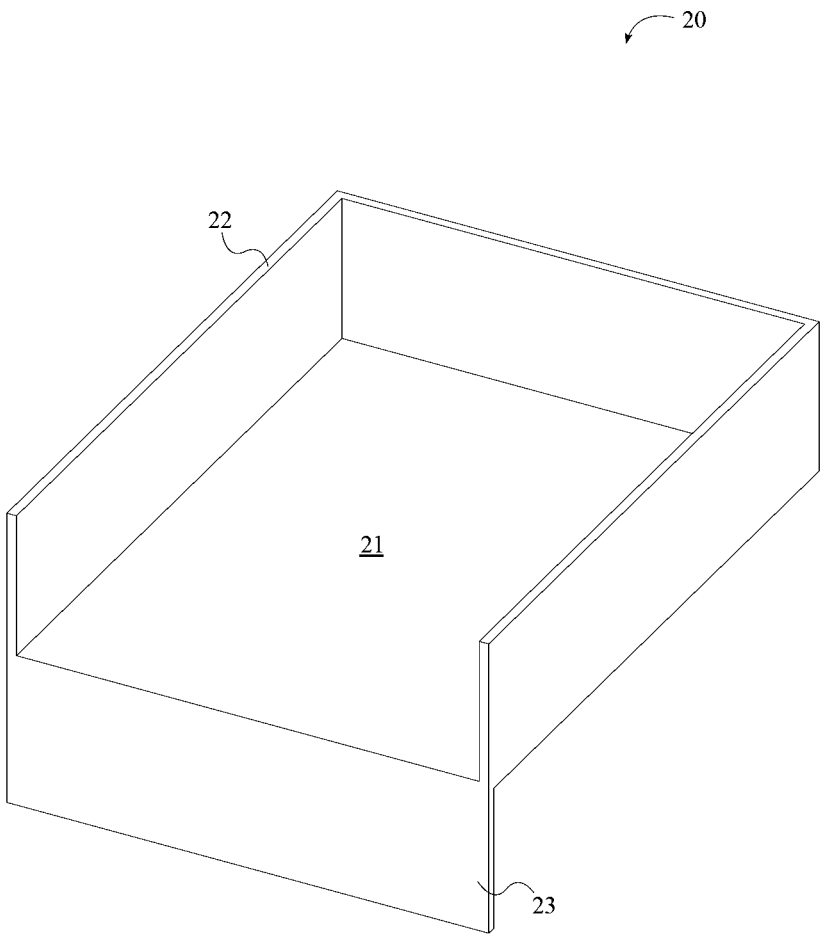
FIG. 4 is a perspective view of the wall bracket for a straight wall.
Figure 5:
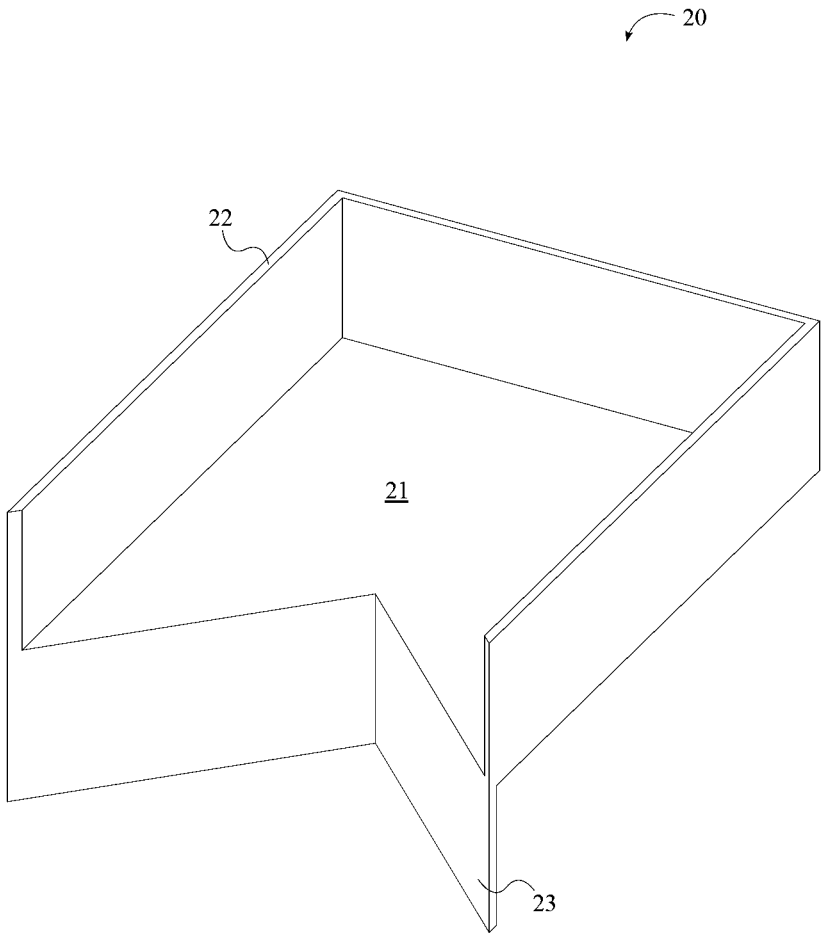
FIG. 5 is a perspective view of the wall bracket for the corner of two walls.

In reference to FIG. 4-5, the wall bracket 20 comprises a bracket base 21, a lateral wall 22, and a stop flange 23. The lateral wall 22 is perimetrically connected to the bracket base 21, wherein a receiving volume is delineated for receiving and retaining the curved beam 30. The stop flange 23 is perpendicularly connected to the bracket base 21 opposite the lateral wall 22, wherein the bracket base 21 and the stop flange 23 are formed to fit around the top edge of a wall. The wall bracket 20 is placed about a wall; the bracket base 21 being positioned flush with the top of the wall and the stop flange 23 being positioned flush with the interior surface of the wall. In the preferred embodiment of the present invention, the lateral wall 22 has an open side. The open side is positioned opposite the stop flange 23, such that the open side is about the interior of the wall, and wherein the curved beam 30 can be slotted into the receiving volume of the wall bracket 20.

Figure 6:
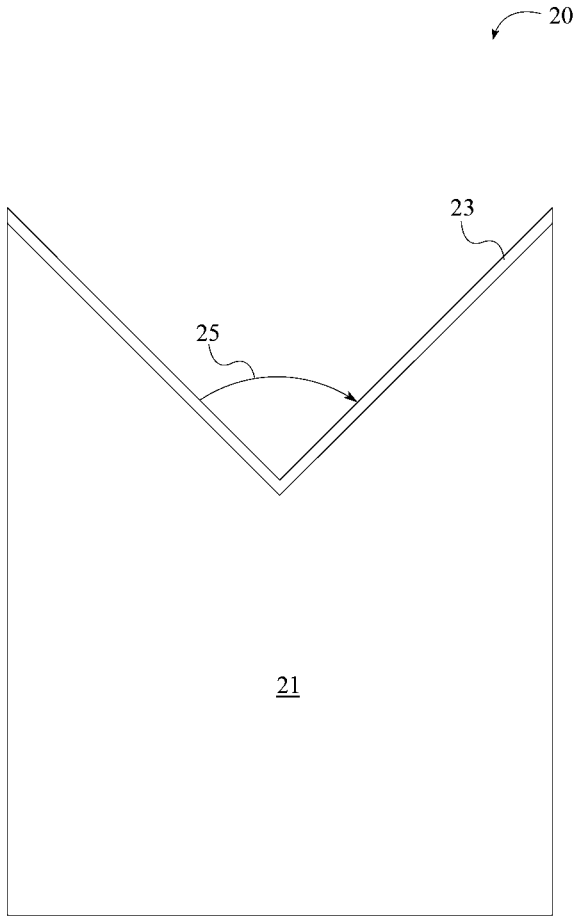
FIG. 6 is a bottom plan view thereof, showing the corner angle of the stop flange.

The wall bracket 20 can be designed for any part of a wall. For a straight wall, the stop flange 23 is straight, as shown in FIG. 4, and for a curved wall, the stop flange 23 is curved. Additionally, the wall bracket 20 can be formed for the corner of a wall, as shown in FIG. 5, wherein the stop flange 23 has a corner angle 25 matching the corner of two walls, as depicted in FIG. 6. For square and rectangular shaped rooms as is most common, the stop flange 23 has a forty five degree angle as to fit the corner of two walls, however, it is possible for the corner angle 25 to be any other value as to conform to any shaped wall structure. The end of the bracket base 21 to which the stop flange 23 is connected is shaped according to the corner angle 25.

Figure 3:
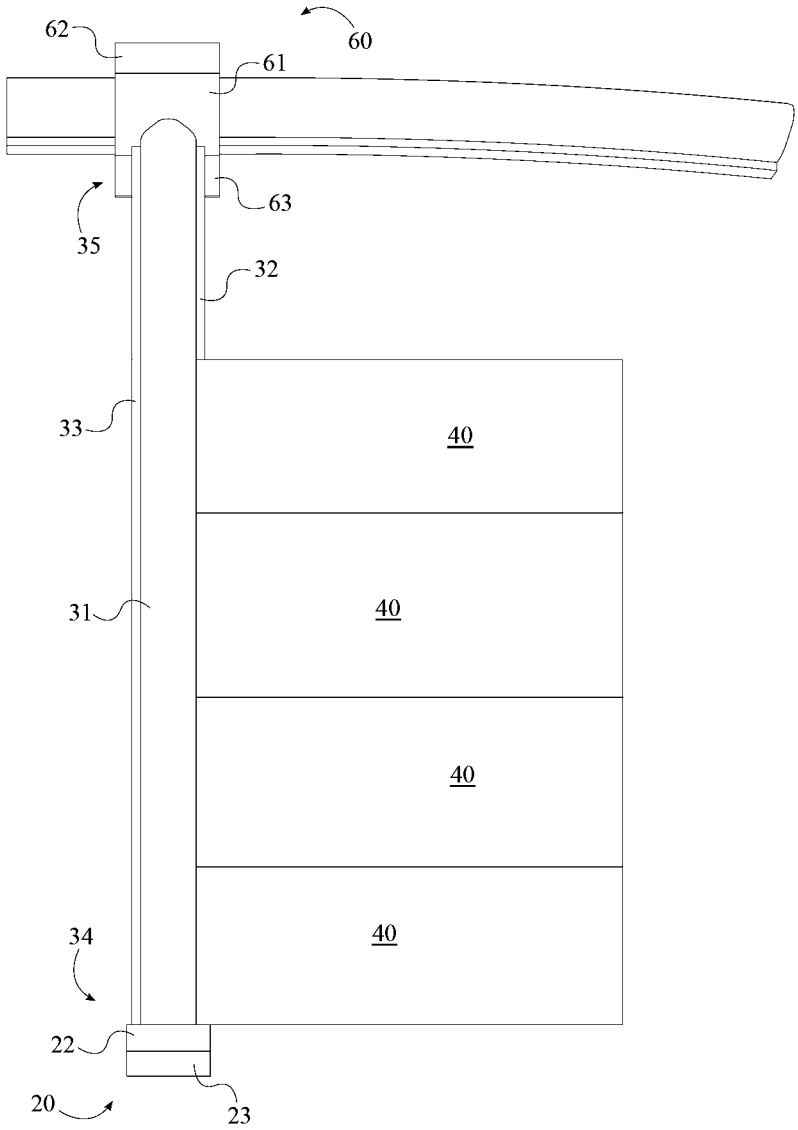
FIG. 3 is a front elevational view of an arbitrary dome section, wherein the curved beam is positioned on an intersection bracket positioned around an adjacent curved beam.

In reference to FIG. 3, the curved beam 30 comprises a beam body 31, a proximal end 34, and a distal end 35; the proximal end 34 and the distal end 35 being positioned opposite each other along the beam body 31. The beam body 31 comprises a first beam flange 32 and a second beam flange 33; the first beam flange 32 and the second beam flange 33 being positioned along the beam body 31. Additionally, the first beam flange 32 and the second beam flange 33 are positioned opposite each other across the beam body 31. The proximal end 34 is positioned into the wall bracket 20; more specifically the receiving volume, wherein the lateral wall 22 is positioned around the proximal end 34. The distal end 35 is positioned either on a temporary central support, as depicted in FIG. 1, or an intersection bracket 60, as shown in FIG. 3, depending on the placement of the curved beam 30.

Figure 7:
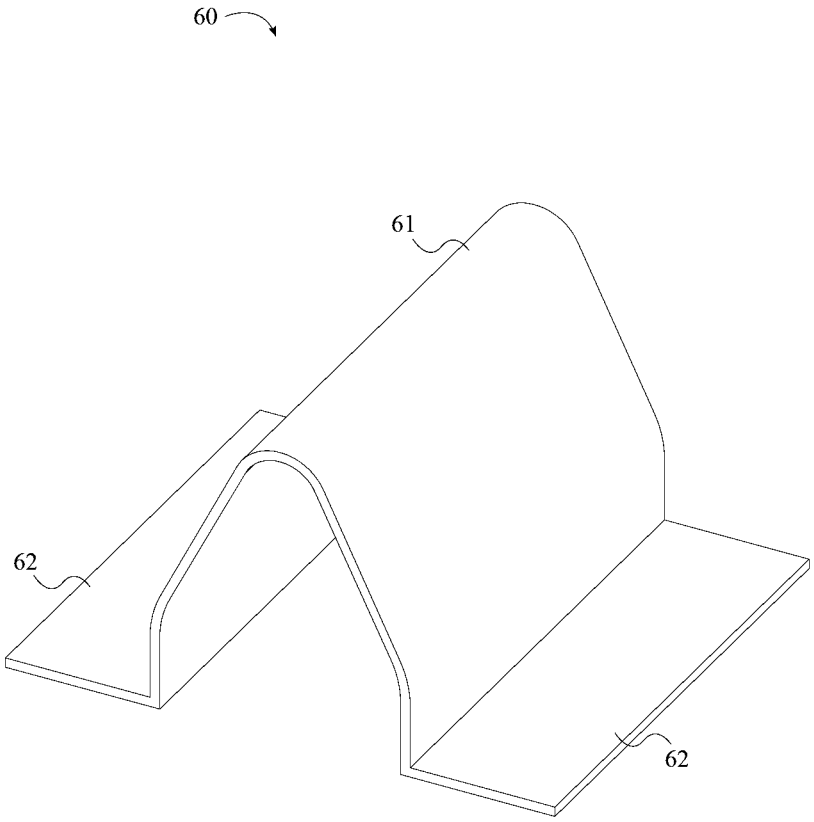
FIG. 7 is a perspective view of the intersection bracket.
Figure 8:
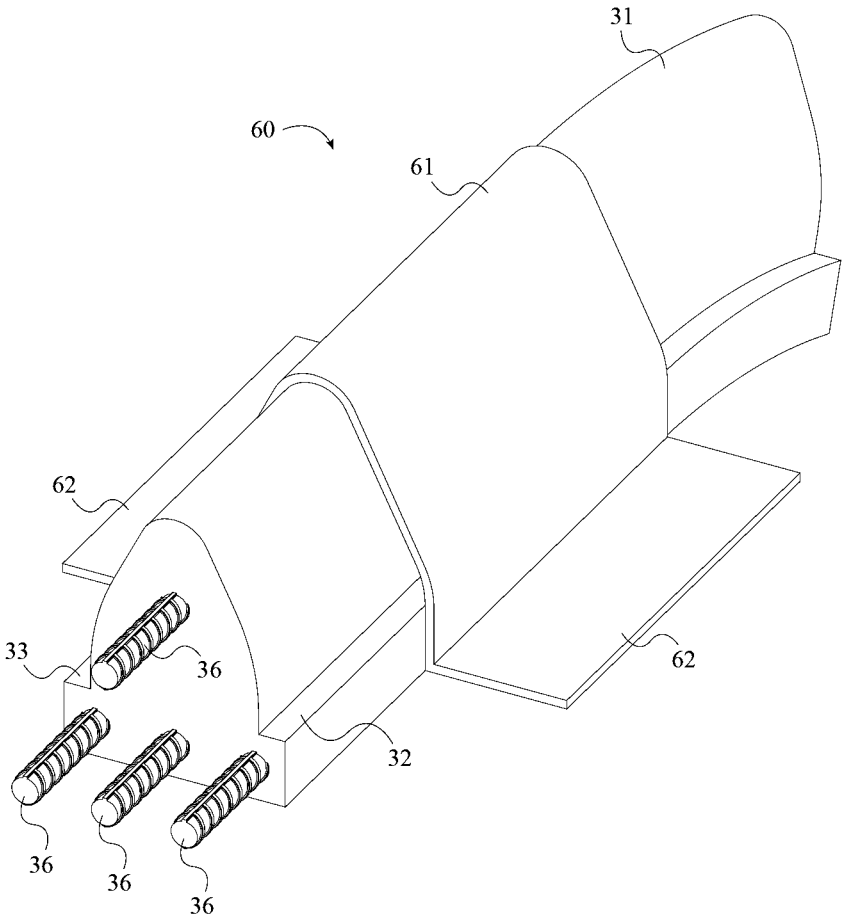
FIG. 8 is a perspective view of the intersection bracket positioned around a curved beam.

In reference to FIG. 7, the intersection bracket 60 comprises a bracket body 61 and a pair of support flanges 62; the pair of support flanges 62 being positioned opposite each other across the bracket body 61. The bracket body 61 is positioned around the curved beam 30 that is mounted about the corner of two walls, or a curved corner beam, wherein the pair of support flanges 62 is positioned opposite each other across the curved corner beam, as shown in FIG. 8. The curved beam 30 that is mounted on one of the two walls is positioned on an adjacent support flange 63 from the pair of support flanges 62, as shown in FIG. 3, while the curved beam 30 that is mounted to the other wall is positioned on the opposite support flange from the pair of support flanges 62.

Figure 9:
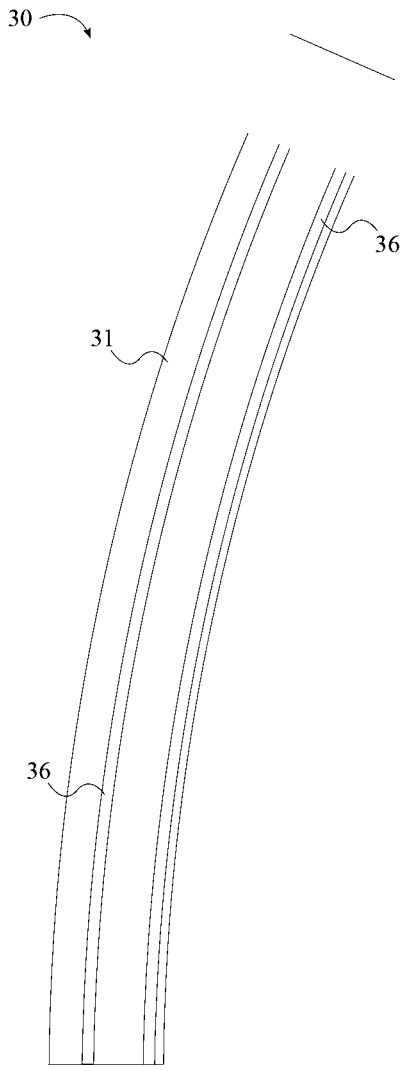
FIG. 9 is a right side sectional view of the curved beam showing the plurality of rebar rods positioned within the beam body.

In reference to FIG. 8-9, in the preferred embodiment of the present invention, the curved beam 30 further comprises a plurality of rebar rods 36, wherein the plurality of rebar rods 36 is positioned along the beam body 31 and traverses through the beam body 31. More specifically, a rebar beam traverses through the first beam flange 32 and the second beam flange 33, and at least one rebar beam traverses through the central portion of the beam body 31 in between the first beam flange 32 and the second beam flange 33. The plurality of rebar rods 36 provide additional strength to structurally reinforce the curved beam 30. Ideally, the plurality of rebar rods 36 are constructed from steel or basalt, however, it is possible for any other suitable material to be used.

Figure 19:
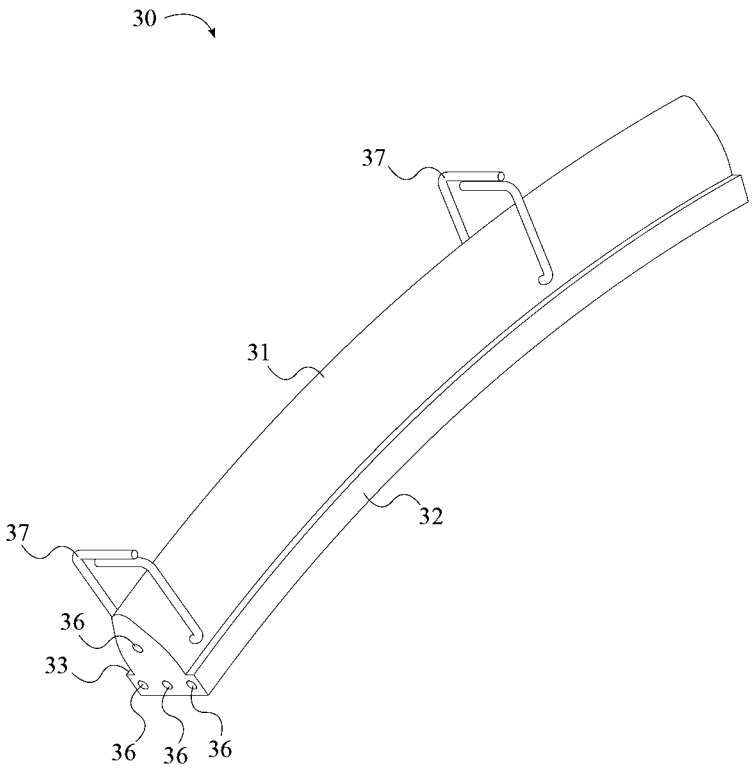
FIG. 19 is a perspective view of the curved beam, wherein a plurality of stirrups is coupled to the curved beam.
Figure 20:
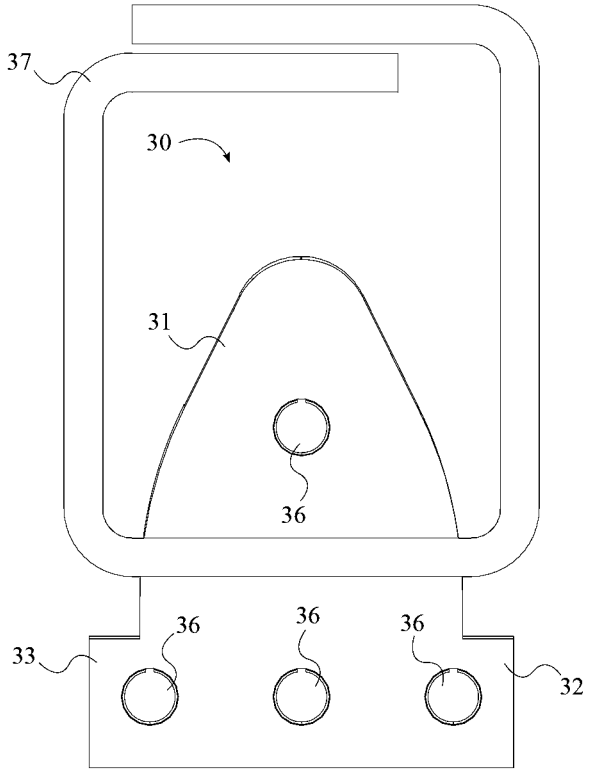
FIG. 20 is a sectional view thereof, showing a stirrup traversing through the beam body.

Additionally, in reference to FIG. 19-20, in the preferred embodiment of the present invention, each of the plurality of dome sections 10 further comprises a plurality of stirrups 37. Each of the plurality of stirrups 37 is coupled to the beam body 31 through a hole traversing through the beam body, perpendicular to the plurality of rebar rods 36. The plurality of stirrups 37 is positioned along the beam body 31, adjacent to the first beam flange 32 and the second beam flange 33. The plurality of stirrups 37 provide additional strength to structurally reinforce the dome enclosure when the bonding material 80 such as concrete is poured by eliminating cold joints between the bonding material 80 and the curved beam 30 of each of the plurality of dome sections 10. Similar to the plurality of rebar rods 36, each of the plurality of stirrups 37 is ideally constructed from steel or basalt, however, it is possible for any other suitable material to be used.

The plurality of blocks 40 is positioned on the first beam flange 32, along the curved beam 30, wherein each of the plurality of blocks 40 is supported by both the curved beam 30 and an adjacent beam. The plurality of blocks 40 provides an interior finish for the dome enclosure and can be constructed from any material, such as wood, concrete, or ceramic. In reference to FIG. 10, the plurality of blocks 40 for an arbitrary section 51 from the plurality of dome sections 10 spans the distance between the arbitrary section 51 and a subsequent section 52 from the plurality of dome sections 10 Likewise, the plurality of blocks 40 for a preceding section 50 from the plurality of dome sections 10 spans the distance between the preceding section 50 and the arbitrary section 51.

Figure 10:
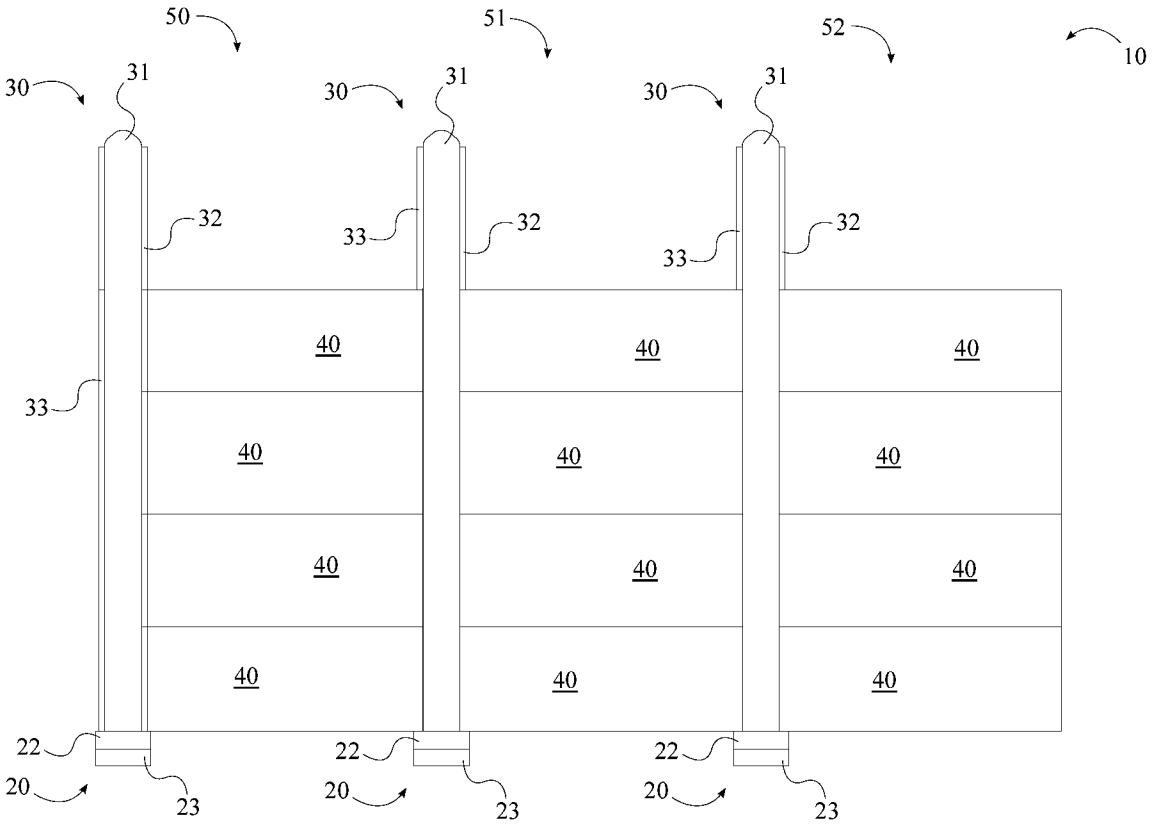
FIG. 10 is a front elevational view of an arbitrary dome section being positioned adjacent to a preceding dome section and a subsequent dome section.
Figure 11:
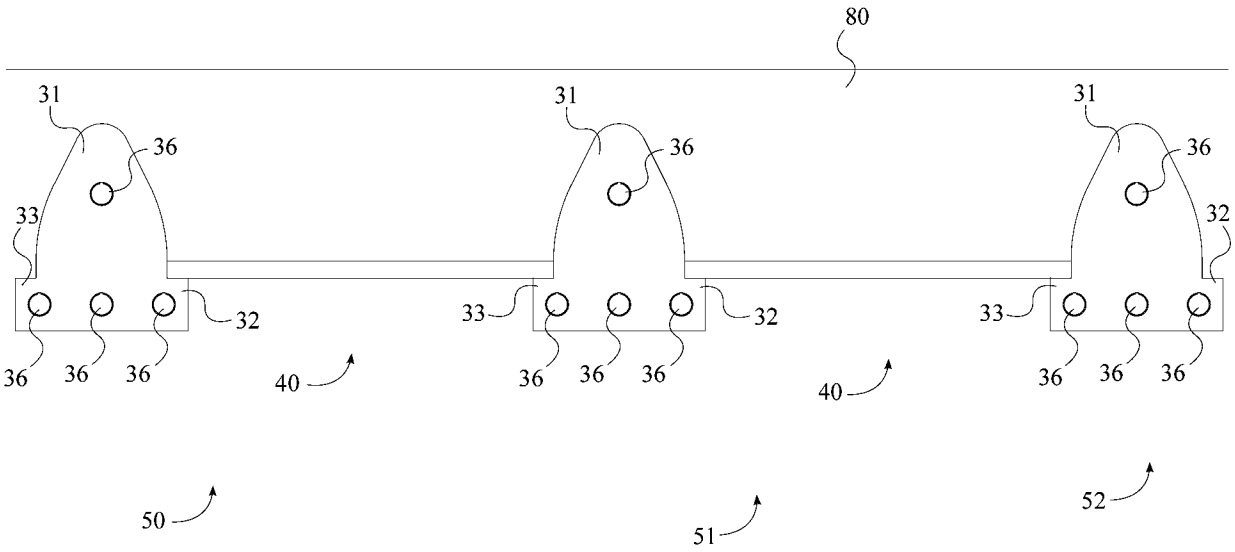
FIG. 11 is a sectional view of the arbitrary dome section, the preceding dome section, and the subsequent dome section being connected to each other by a bonding material.

In reference to FIG. 10-11, the curved beam 30 of the arbitrary section 51 and the curved beam 30 of the subsequent section 52 supports the plurality of blocks 40 of the arbitrary section 51, wherein the plurality of blocks 40 of the arbitrary section 51 is positioned along the curved beam 30 of the arbitrary section 51 and the curved beam 30 of the subsequent section 52. The plurality of blocks 40 of the arbitrary section 51 is positioned on the first beam flange 32 of the arbitrary section 51 and connected to the curved beam 30 of the arbitrary section 51 by the bonding material 80. Similarly, the plurality of blocks 40 of the arbitrary section 51 is positioned on the second beam flange 33 of the subsequent section 52 and connected to the curved beam 30 of the subsequent section 52 by the bonding material 80, as shown in FIG. 11. In this way, the plurality of blocks 40 of the arbitrary section 51 spans the distance between the arbitrary section 51 and the subsequent section 52.

In further reference to FIG. 10-11, the curved beam 30 of the preceding section 50 and the curved beam 30 of the arbitrary section 51 supports the plurality of blocks 40 of the preceding section 50, wherein the plurality of blocks 40 of the preceding section 50 is positioned along the curved beam 30 of the preceding section 50 and the curved beam 30 of the arbitrary section 51. The plurality of blocks 40 of the preceding section 50 is positioned on the first beam flange 32 of the preceding section 50 and connected to the curved beam 30 of the preceding section 50 by the bonding material 80. Similarly, the plurality of blocks 40 of the preceding section 50 is positioned on the second beam flange 33 of the arbitrary section 51 and connected to the curved beam 30 of the arbitrary section 51 by the bonding material 80, as shown in FIG. 11. In this way, the plurality of blocks 40 of the preceding section 50 spans the distance between the preceding section 50 and the arbitrary section 51.

In reference to FIG. 1, the following describes one example of the present invention, wherein the wall structure is rectangular and the curved beam 30 of the arbitrary section 51 extends from the center of one wall. The distal end 35 of the curved beam 30 of the arbitrary section 51 is positioned onto the temporary central support mentioned above. The temporary central support is, as indicated by the name, a temporary structure that supports the curved beam 30 from each of the plurality of dome sections 10 that is directed towards the center of the dome enclosure. The preceding section 50 and the subsequent section 52 are positioned to either side of the arbitrary section 51 along the one wall, wherein the curved beam 30 of the preceding section 50 and the curved beam 30 of the subsequent section 52 are positioned parallel with the curved beam 30 of the arbitrary section 51. The curved beam 30 of the preceding section 50 is directed towards the curved corner beam mounted about one corner of the wall structure; wherein the curved beam 30 of the preceding section 50 is positioned on the adjacent support flange 63 of the intersection bracket 60 positioned around the curved corner beam. Similarly, the curved beam 30 of the subsequent section 52 is directed towards the curved corner beam mounted about the opposite corner of the wall structure along the one wall; wherein the curved beam 30 of the subsequent section 52 is positioned on the adjacent support flange 63 of the intersection bracket 60 positioned around the curved corner beam.

Once each of the plurality of dome sections 10 has been properly positioned about the wall structure, the bonding material 80 is poured over, or otherwise applied to, the plurality of dome sections 10. In the preferred embodiment of the present invention, the bonding material 80 is concrete, wherein the concrete is poured over the curved beam 30 and the plurality of blocks 40 of each of the plurality of dome sections 10, and once hardened, the plurality of dome sections 10 and the bonding material 80 are formed into one structure.

Figure 12:
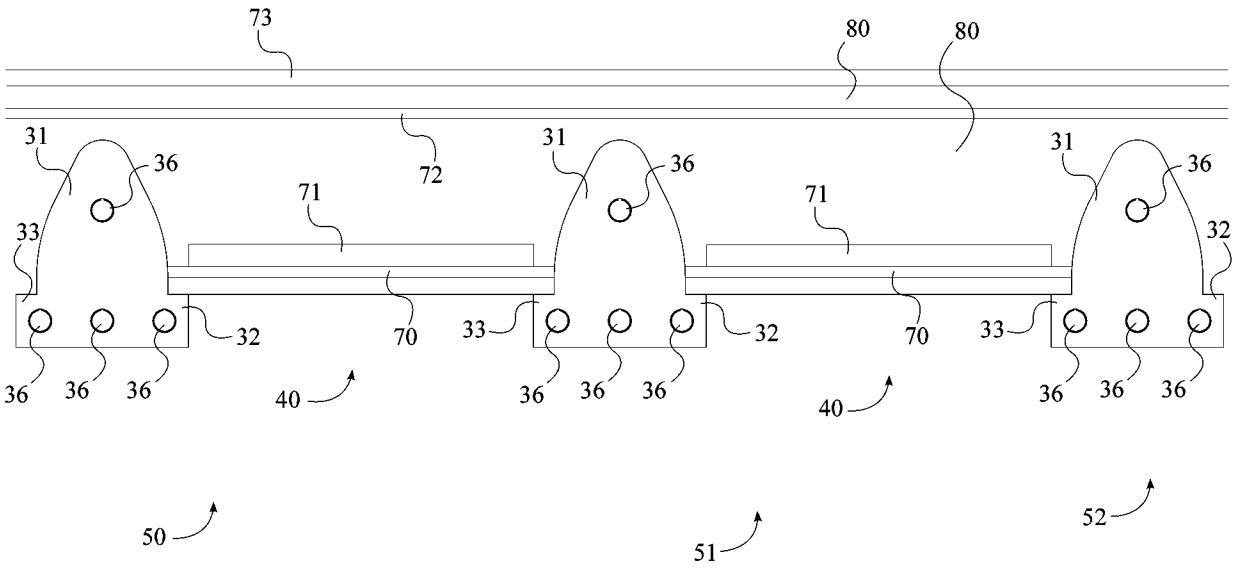
FIG. 12 is a sectional view thereof, wherein a protective membrane, insulation material, and rebar grid are further encased by the bonding material, and wherein an exterior finish is applied to the bonding material.

In reference to FIG. 12, depending on the material used for the plurality of blocks 40, each of the plurality of dome sections 10 may further comprise a protective membrane 70. The protective membrane 70 is applied only to the plurality of blocks 40, and is positioned in between the plurality of blocks 40 and the bonding material 80. For example, if each of the plurality of blocks 40 is constructed from wood, then it would be beneficial to cover the wood before pouring concrete. In such a case, the protective membrane 70 may be a sheet of plastic, a spray foam, or any other suitable material.

In further reference to FIG. 12, depending on the climate the dome enclosure is constructed in, each of the plurality of dome sections 10 may further comprise an insulation material 71. The insulation material 71 is positioned adjacent to the plurality of blocks 40 and is encased within the bonding material 80. It is also possible for the bonding material 80 to dually function as the insulation material 71. If the insulation material 71 is used in conjunction with the protective membrane 70, then the protective membrane 70 is positioned in between the plurality of blocks 40 and the insulation material 71.

In yet further reference to FIG. 12, depending on the structural requirements of the dome enclosure, each of the plurality of dome sections 10 may further comprise a rebar grid 72. The rebar grid 72 is positioned within the bonding material 80 and acts to provide additional strength to the bonding material 80 once the bonding material 80 sets. Ideally, the rebar grid 72 is constructed from steel or basalt, however, it is possible for any other suitable materials to be used.

Further referencing FIG. 12, to further enhance the exterior aesthetics of the dome enclosure, the present invention may further include an exterior finish 73. The exterior finish 73 is applied to the bonding material 80 opposite the curved beam 30 and the plurality of blocks 40. Depending on the material used for the exterior finish 73, the exterior finish 73 may be applied before or after the bonding material 80 sets. Materials for the exterior finish 73 can include, but are not limited to, wood, metal, ceramic, earth or dirt, or stucco.

Figure 13:
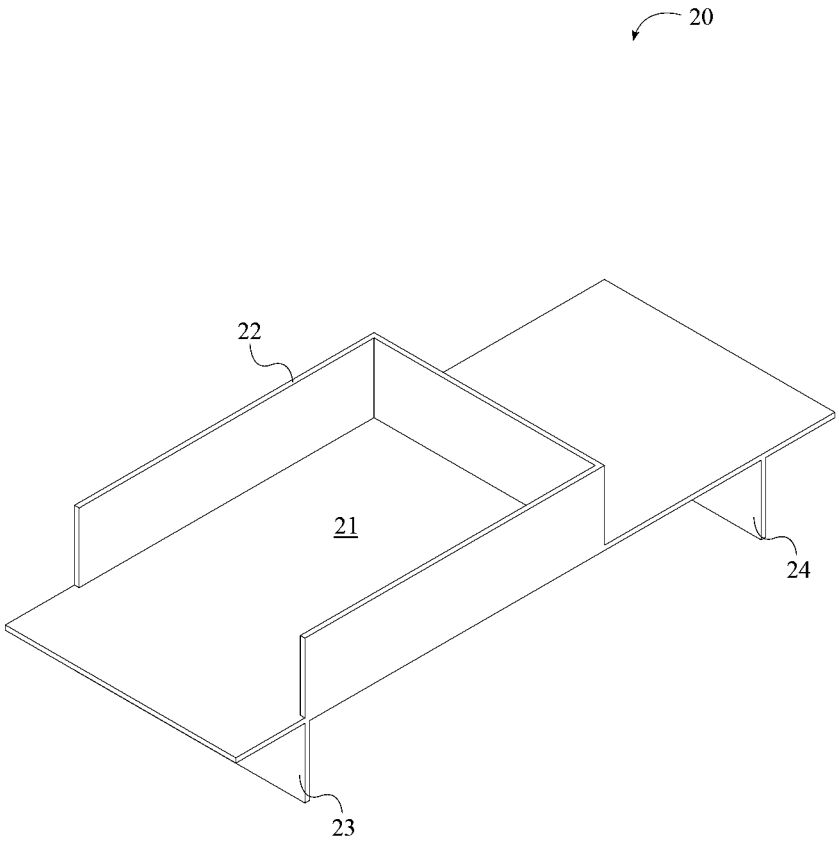
FIG. 13 is a perspective view of the wall bracket for a straight wall having a second stop flange.
Figure 14:
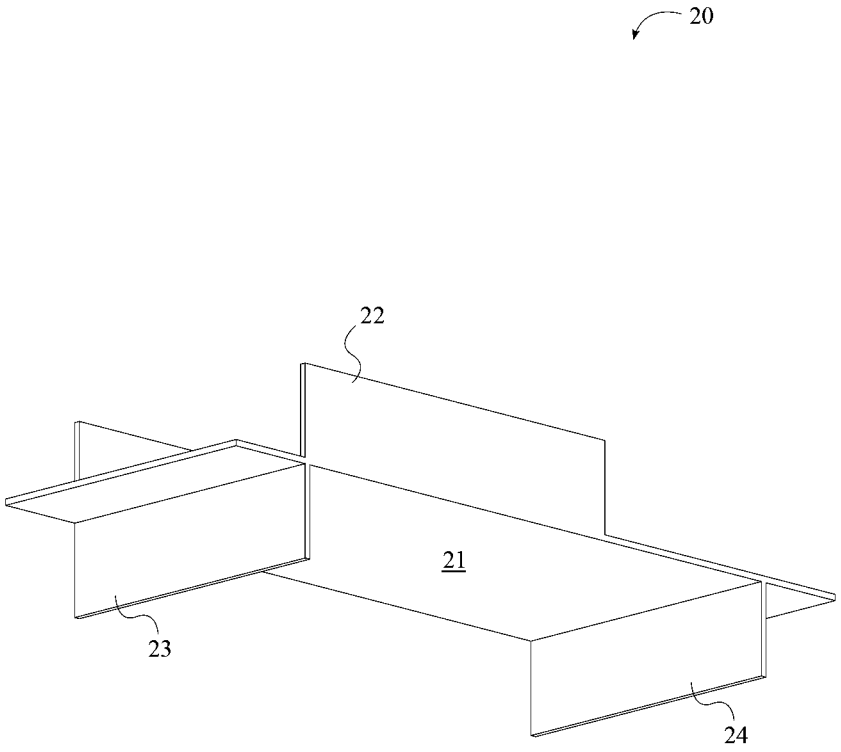
FIG. 14 is a bottom perspective view thereof.
Figure 15:
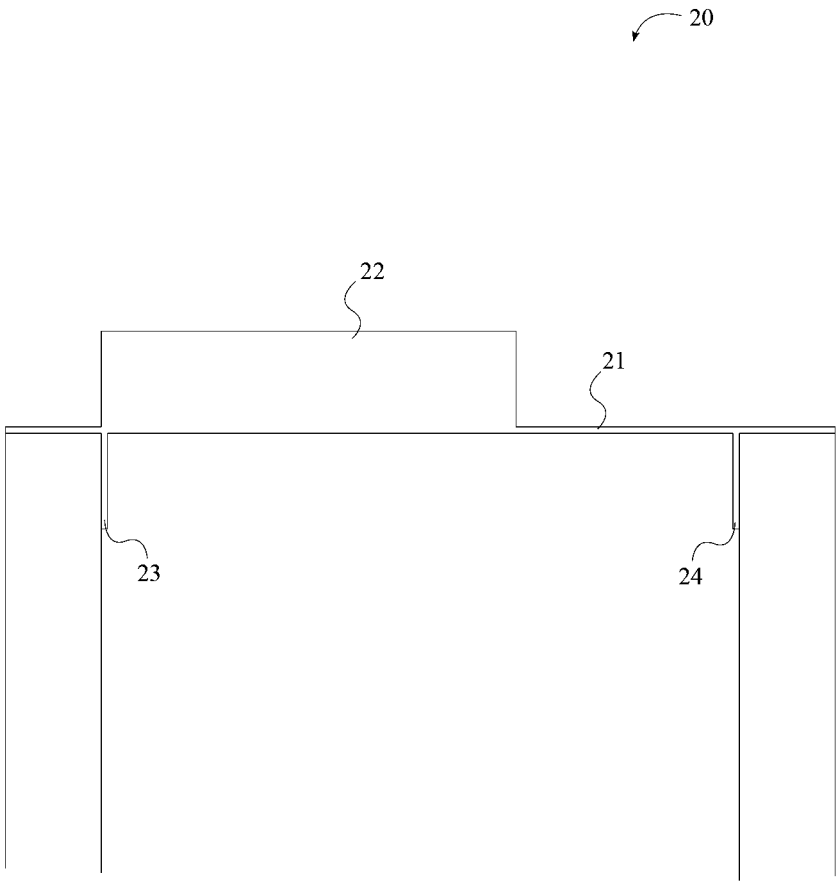
FIG. 15 is a right side elevational view thereof, wherein the wall bracket is positioned on top of two wall forms.

In reference to FIG. 13-14, in an alternative embodiment of the present invention, there is also the possibility of performing a monolithic pour, meaning pouring the wall and dome enclosure in one pour, in which case the bonding material 80 is concrete, and for this the wall bracket 20 further comprises a second stop flange 24. Similar to the stop flange 23, the second stop flange 24 is perpendicularly connected to the bracket base 21 opposite the lateral wall 22; the stop flange 23 and the second stop flange 24 being positioned opposite each other along the bracket base 21. The addition of the second stop flange 24 allows the wall bracket 20 to be used when the walls and the dome are poured in one operation. The wall bracket 20 is positioned on top of two forms that are positioned to delineate the shape of the wall, as shown in FIG. 15; the stop flange 23 and the second stop flange 24 being positioned in between the two forms, flush against the interior surfaces, and the bracket base 21 being positioned flush about the top of the two forms. Concrete can then be poured over each of the plurality of dome sections 10 and between the two forms, such that a single structure is formed, as opposed to the cold joints formed when constructing the dome enclosure about an existing wall.

Figure 16:
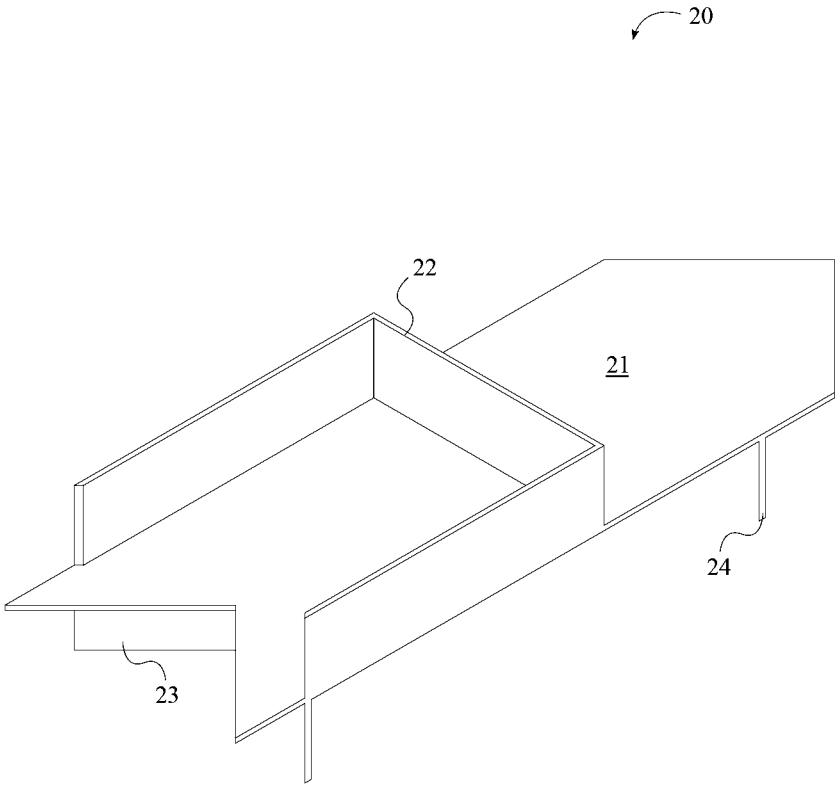
FIG. 16 is a perspective view of the wall bracket for the corner of two walls having a second stop flange.
Figure 17:
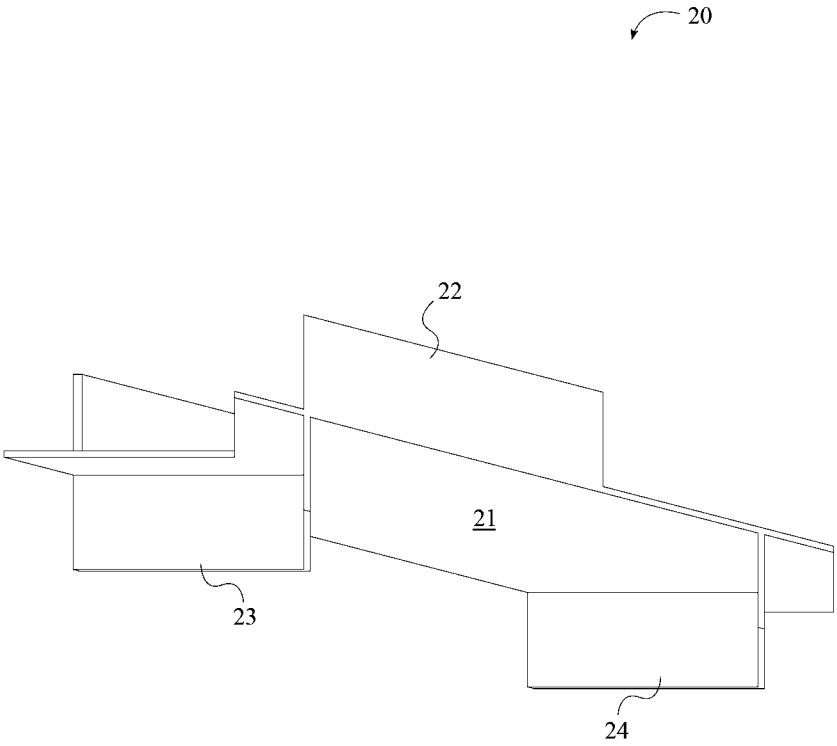
FIG. 17 is a bottom perspective view thereof.
Figure 18:
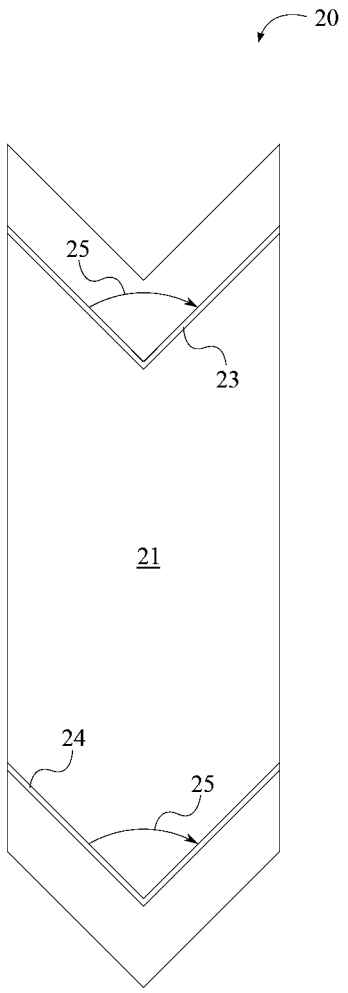
FIG. 18 is a bottom plan view thereof, showing the corner angle of the stop flange and the second stop flange.

Similar to the stop flange 23, for a straight wall, the second stop flange 24 is straight, as shown in FIG. 13-14, and for a curved wall, the second stop flange 24 is curved. Additionally, the second stop flange 24 can be formed for the corner of a wall, as shown in FIG. 16-17, wherein the second stop flange 24 has a corner angle 25 matching the corner of two walls, as depicted in FIG. 18. For square and rectangular shaped rooms as is most common, the second stop flange 24 has a forty five degree angle as to fit the corner of two walls, however, it is possible for the corner angle 25 to be any other value as to conform to any shaped wall structure. The end of the bracket base 21 to which the second stop flange 24 is connected is shaped according to the corner angle 25.

Although the invention has been explained in relation to its preferred embodiment, it is to be understood that many other possible modifications and variations can be made without departing from the spirit and scope of the invention as hereinafter claimed.

What is claimed is:

1. A dome enclosure comprises:

a plurality of dome sections;

a bonding material;

each of the plurality of dome sections comprises a curved beam, a wall bracket, and a plurality of blocks;

the wall bracket comprises a bracket base, a lateral wall, and a stop flange;

the curved beam comprises a beam body, a proximal end, and a distal end;

the beam body comprises a first beam flange and a second beam flange;

the lateral wall being perimetrically connected to the bracket base;

the stop flange being perpendicularly connected to the bracket base opposite the lateral wall;

the distal end and the proximal end being positioned opposite each other along the beam body;

the proximal end being positioned into the wall bracket;

the lateral wall being positioned around the proximal end;

the first beam flange and the second beam flange being positioned along the beam body;

the first beam flange and the second beam flange being positioned opposite each other across the beam body;

the plurality of blocks being positioned along the curved beam;

the plurality of blocks being positioned on the first beam flange;

the plurality of blocks being connected to the curved beam by the bonding material; and the plurality of dome sections being encased by the bonding material.

2. The dome enclosure as claimed in claim 1 comprises:

the plurality of dome sections comprises an arbitrary section and a preceding section;

the plurality of blocks of the preceding section being positioned along the curved beam of the arbitrary section; and the plurality of blocks of the preceding section being positioned on the second flange of the arbitrary section.

3. The dome enclosure as claimed in claim 2 comprises:

the plurality of blocks of the preceding section being connected to the curved beam of the arbitrary section by the bonding material.

4. The dome enclosure as claimed in claim 2 comprises:

the curved beam of the arbitrary section being positioned parallel with the curved beam of the preceding section.

5. The dome enclosure as claimed in claim 1 comprises:

the plurality of dome sections comprises an arbitrary section and a subsequent section;

the plurality of blocks of the arbitrary section being positioned along the curved beam of the subsequent section; and the plurality of blocks of the arbitrary section being positioned on the second flange of the subsequent section.

6. The dome enclosure as claimed in claim 5 comprises:

the plurality of blocks of the arbitrary section being connected to the curved beam of the subsequent section by the bonding material.

7. The dome enclosure as claimed in claim 5 comprises:

the curved beam of the subsequent section being positioned parallel with the curved beam of the arbitrary section.

8. The dome enclosure as claimed in claim 1 comprises:

an intersection bracket;

the intersection bracket comprises a bracket body and a pair of support flanges; and the pair of support flanges being positioned opposite each other across the bracket body.

9. The dome enclosure as claimed in claim 8 comprises:

the bracket body being positioned around the curved beam; and the pair of supports flanges being positioned opposite each other across the curved beam.

10. The dome enclosure as claimed in claim 8 comprises:

the curved beam being positioned on an adjacent support flange from the pair of support flanges.

11. The dome enclosure as claimed in claim 1 comprises:

the wall bracket further comprises a second stop flange;

the second stop flange being perpendicularly connected to the bracket base opposite the lateral wall; and the second stop flange and the stop flange being positioned opposite each other along the bracket base.

12. The dome enclosure as claimed in claim 11 comprises:

the stop flange and the second stop flange having a corner angle.

13. The dome enclosure as claimed in claim 12 comprises:

the corner angle being forty five degrees.

14. The dome enclosure as claimed in claim 1 comprises:

the stop flange having a corner angle.

15. The dome enclosure as claimed in claim 14 comprises:

the corner angle being forty five degrees.

16. The dome enclosure as claimed in claim 1 comprises:

the curved beam further comprises a plurality of rebar beams;

the plurality of rebar beams being positioned along the beam body; and the plurality of rebar beams traversing through the beam body.

17. The dome enclosure as claimed in claim 1 comprises:

each of the plurality of dome sections further comprises a plurality of stirrups;

the plurality of stirrups being coupled to the beam body;

the plurality of stirrups being positioned along the beam body; and the plurality of stirrups being positioned adjacent to the first beam flange and the second beam flange.

18. The dome enclosure as claimed in claim 1 comprises:

each of the plurality of dome sections further comprises a protective membrane; and the protective membrane being positioned in between the plurality of blocks and the bonding material.

19. The dome enclosure as claimed in claim 1 comprises:

each of the plurality of dome sections further comprises a rebar grid; and the rebar grid being positioned within the bonding material.

20. The dome enclosure as claimed in claim 1 comprises:

an exterior finish; and the exterior finish being applied to the bonding material opposite the curved beam and the plurality of blocks.

* * * * *